US009568878B2

(12) United States Patent
Ogino

(10) Patent No.: US 9,568,878 B2
(45) Date of Patent: Feb. 14, 2017

(54) IMAGE FORMING APPARATUS AND FEEDING DEVICE THAT DETECT SHEETS WITH A SENSOR THAT IS CHOSEN ACCORDING TO SHEET SPACING

(71) Applicant: CANON KABUSHIKI KAISHA, Tokyo (JP)

(72) Inventor: Kosuke Ogino, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/173,406

(22) Filed: Jun. 3, 2016

(65) Prior Publication Data

US 2016/0282789 A1 Sep. 29, 2016

Related U.S. Application Data

(63) Continuation of application No. 14/581,479, filed on Dec. 23, 2014, now Pat. No. 9,383,707.

(30) Foreign Application Priority Data

Dec. 25, 2013 (JP) ..... 2013-267129
Nov. 6, 2014 (JP) ..... 2014-226483

(51) Int. Cl.
*B65H 7/02* (2006.01)
*G03G 15/00* (2006.01)

(52) U.S. Cl.
CPC ..... *G03G 15/6508* (2013.01); *B65H 7/02* (2013.01); *B65H 2513/511* (2013.01); *B65H 2513/514* (2013.01); *G03G 2215/00599* (2013.01); *G03G 2215/00734* (2013.01)

(58) Field of Classification Search
CPC ..... G03G 15/6555; G03G 15/6508; G03G 15/6564; G03G 2215/00599; G03G 2215/00734; G03G 15/6558; B65H 7/06; B65H 7/02; B65H 2513/511; B65H 2513/514; B65H 2701/1311
See application file for complete search history.

(56) References Cited

U.S. PATENT DOCUMENTS 5,489,970 A * 2/1996 Nishida ..... G03G 15/6564 399/381
7,068,969 B2 * 6/2006 Ueda ..... B65H 3/06 271/10.02

(Continued)

*Primary Examiner* — Justin Olamit
(74) *Attorney, Agent, or Firm* — Canon USA, Inc. I.P. Division

(57) ABSTRACT

An image forming apparatus according to the invention(s) has the following feature(s): When first and second recording materials have a first length and a sum of the first length and an interval is less than a distance from a regulation position, where an accommodation unit regulates a leading edge of a recording material, to a second position, a feeding unit feeds a second recording material in accordance with a timing in which a first detecting unit detects the first recording material. When the first and second recording materials have a second length that is longer than the first length and a sum of the second length and the interval is greater than or equal to the distance from the regulation position to the second position, the feeding unit feeds the second recording material in accordance with a timing in which the second detecting unit detects the first recording material.

13 Claims, 7 Drawing Sheets

(56) References Cited

U.S. PATENT DOCUMENTS

| | | | | |
|---|---|---|---|---|
| 7,731,183 | B2 * | 6/2010 | Ohno | B65H 1/266<br>271/171 |
| 8,054,475 | B2 * | 11/2011 | Takahashi | B41J 11/485<br>271/126 |
| 8,757,617 | B2 * | 6/2014 | Fukusada | B65H 5/06<br>271/258.01 |
| 2010/0244353 | A1 * | 9/2010 | Kaida | B65H 3/06<br>271/3.08 |

* cited by examiner

IMAGE FORMING APPARATUS AND FEEDING DEVICE THAT DETECT SHEETS WITH A SENSOR THAT IS CHOSEN ACCORDING TO SHEET SPACING

CROSS-REFERENCE TO RELATED APPLICATIONS

This application is a continuation, and claims the benefit, of U.S. patent application Ser. No. 14/581,479, presently pending and filed on Dec. 23, 2014, and claims the benefit of, and priority to, Japanese Patent Application No. 2013-267129, filed Dec. 25, 2013, and Japanese Patent Application No. 2014-226483, filed Nov. 6, 2014, which applications are hereby incorporated by reference herein in their entireties.

BACKGROUND OF THE INVENTION

Field of the Invention

The present invention(s) relate to at least one image forming apparatus that controls an interval between recording materials on which images are formed, and at least one feeding device related to, and for use with, same.

Description of the Related Art

Hitherto, in image forming apparatuses, such as copying machines and printers, productivity (that is, the number of sheets subjected to image formation per unit time) is increased by reducing an interval between recording materials when the recording materials are continuously conveyed. The phrase "interval between recording materials" refers to the distance between a trailing edge of a first recording material that is fed first, (that is, an end portion of the recording material at an upstream side in a conveying direction of recording materials) and a leading edge of a second recording material that is the next recording material fed after the first recording material (that is, an end portion of the recording material at a downstream side in the conveying direction of the recording materials). Here, when the interval between the recording materials is reduced, the first recording material and the second recording material may be conveyed while they are superposed upon each other when feeding or conveyance variations occur. Therefore, it is necessary to control the interval between the recording materials at a constant interval.

Japanese Patent Laid-Open No. 2000-335759 discusses an image forming apparatus including a sensor that detects a leading edge of a recording material fed from a cassette that accommodates recording materials. In the image forming apparatus, in accordance with a timing in which a leading edge of a first recording material that has been fed first is detected, a timing in which a second recording material is fed is determined. Therefore, for example, if a surface of a pickup roller that feeds the recording materials from the cassette is worn, and slippage occurs when the first recording material is being fed, the timing in which the leading edge of the first recording material is detected by the sensor is delayed. In this case, since the timing in which the second recording material is fed from the cassette is also delayed, it is possible to feed the first recording material and the second recording material with the interval between the recording materials being kept at a constant interval. That is, even if the timing in which the recording materials are fed is changed due to the influence of pickup roller slippage, the interval between the recording materials can be controlled at a constant interval.

However, in Japanese Patent Laid-Open No. 2000-335759, the timing in which the second recording material is fed is determined using the detection result provided by a particular sensor at all times. Therefore, when the length of the recording material in the conveying direction thereof is long, the time that is taken to feed the second recording material after the sensor has detected the leading edge of the first recording material is longer than that when the length of the recording material in the conveying direction thereof is short. As the time is increased, larger conveyance variations may occur.

SUMMARY OF THE INVENTION

The present invention(s) provide at least one image forming apparatus that controls an interval between a plurality of recording materials with a small and constant interval therebetween when the plurality of recording materials are continuously fed regardless of the length of the recording materials in a conveying direction thereof.

To this end, according to at least one aspect of the present invention(s), there is provided at least one image forming apparatus including an accommodation unit that accommodates one or more recording materials while regulating a leading edge of each of the one or more recording materials, a feeding unit that, when the one or more recording materials is a plurality of recording materials and when continuously feeding the recording materials accommodated in the accommodation unit, feeds a second recording material of the plurality of recording materials to a conveying path with an interval being provided between a trailing edge of a first recording material of the plurality of recording materials and a leading edge of the second recording material after the first recording material has been fed to the conveying path, a first detecting unit that detects a recording material fed by the feeding unit at a first position in the conveying path, and a second detecting unit that detects a recording material fed by the feeding unit at a second position that is situated downstream from the first position in a conveying direction of the recording material. When the first recording material and the second recording material have a first length in the conveying direction and when a value that is a sum of the first length and the interval is less than a distance at the conveying path from a regulation position to the second position, the feeding unit feeds the second recording material in accordance with a timing in which the first detecting unit detects the first recording material, the regulation position being where the accommodation unit regulates the leading edge of each of the plurality of recording materials. When the first recording material and the second recording material have a second length that is longer than the first length in the conveying direction and when a value that is a sum of the second length and the interval is greater than or equal to the distance at the conveying path from the regulation position to the second position, the feeding unit feeds the second recording material in accordance with a timing in which the second detecting unit detects the first recording material. According to other aspects of the present invention(s), other apparatuses, including other image forming apparatuses and feeding devices, are discussed herein.

Further features of the present invention(s) will become apparent from the following description of exemplary embodiments with reference to the attached drawings.

DESCRIPTION OF THE EMBODIMENTS

Exemplary embodiments of the present invention(s) are hereunder described with reference to the drawings. The exemplary embodiments below do not limit the invention(s) related to the claims. Not all combinations of the features described in the embodiments are required as solving means of the invention(s).

First Embodiment

Description of Image Forming Apparatus

Figure 1:
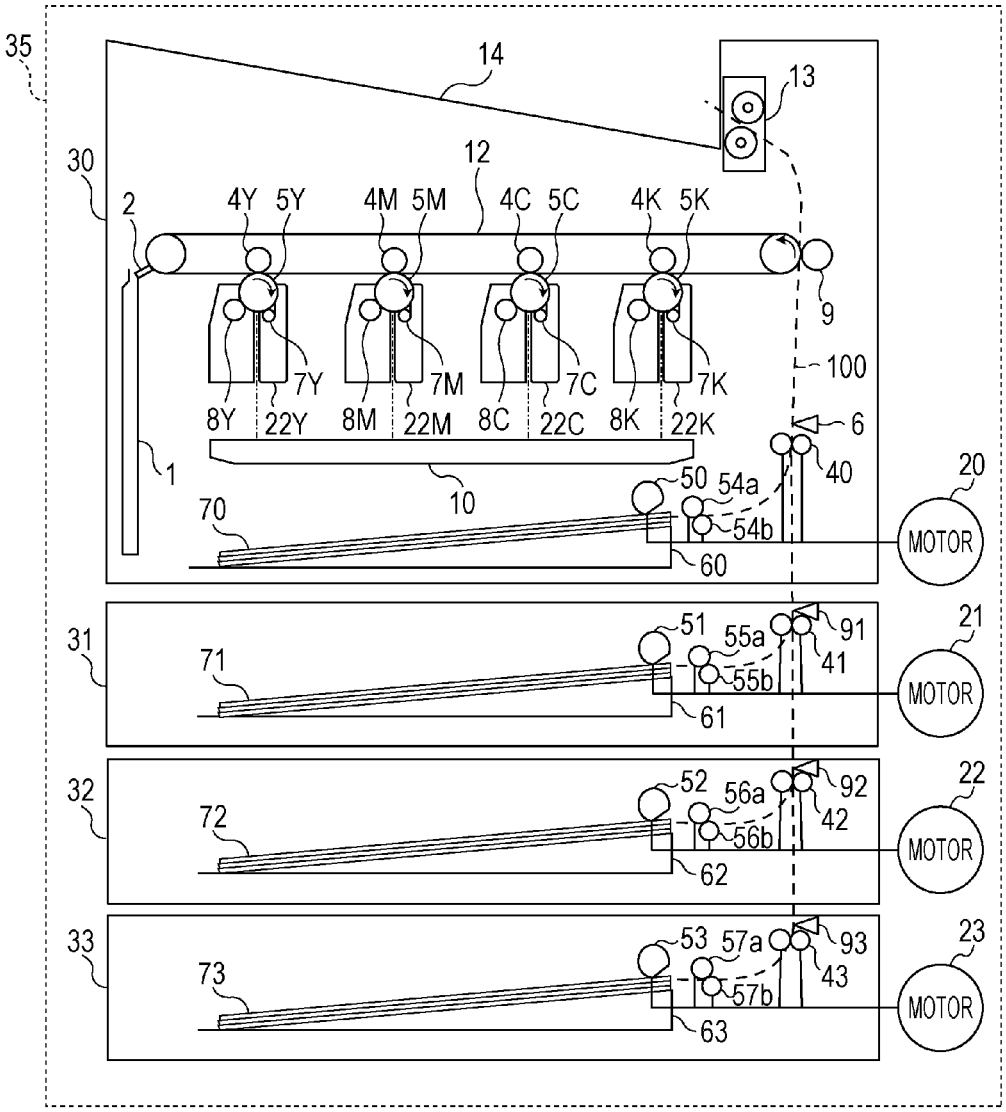
FIG. 1 is a sectional view of an image forming apparatus and a feeding device according to a first embodiment of the present invention(s).

FIG. 1 is a sectional view of an image forming apparatus 35 according to an embodiment. The image forming apparatus 35 according to the embodiment includes a main body device 30, which forms images on recording materials, and feeding devices 31 to 33, which feed the recording materials. In order to form a full-color image by superimposing images of four colors, that is, a yellow (Y) image, a magenta (M) image, a cyan (C) image, and a black (K) image, upon each other, the device 30 used in the embodiment includes image forming units corresponding to the four colors. Since the image forming units corresponding to the four colors have the same structure, the image forming units are hereunder described without using the reference characters Y, M, C, and K.

Photoconductor drums 5, serving as image carrying members, each include an aluminum cylinder to whose outer periphery an organic photoconductive layer is applied. Each photoconductor drum 5 rotates at a predetermined circumferential speed as a result of transmitting driving force of a motor, serving as a driving unit, to each photoconductor drum 5. When each drum 5 is rotating at the predetermined circumferential speed, each photoconductor drum 5 is uniformly charged to a predetermined polarity/potential by a charging roller 7, serving as a charging unit. The surface of each charged photoconductor drum 5 is irradiated with a laser beam from an exposure device 10, serving as an exposure unit, and the surface potential of each irradiated portion is changed, so that an electrostatic latent image is formed on the surface of each photoconductor drum 5. The formed electrostatic latent images are formed into toner images of the corresponding colors, which are in accordance with the electrostatic latent images, by corresponding developing rollers 8 serving as developing units. The drums 5, the rollers 7, and the rollers 8 are integrated as cartridges 22, and are removable with respect to the device 30. A user can replace the cartridges 22 with new cartridges 22 in accordance with the life of the drums 5, the rollers 7, and the rollers 8. Therefore, the user himself/herself is capable of maintaining the device 30 without depending upon a serviceman. The embodiment is not limited to such a cartridge-type device. The embodiment is also applicable to a structure in which the drums 5, the rollers 7, and the rollers 8 are fixed to the device (that is, a type in which members need not be replaced).

The toner image formed on each photoconductor drum 5 is first-transferred to an intermediate transfer belt 12, serving as an intermediate transfer member, as a result of applying a voltage to a first transfer roller 4, serving as a first transfer unit. The belt 12 is disposed so as to contact the photoconductor drums 5 at positions opposing the drums 5. The belt 12 is rotationally driven at substantially the same circumferential speed as the drums 5. When the toner image formed on each drum 5 passes a contact portion between the belt 12 and each drum 5, the toner images are successively first-transferred to the belt 12 starting with the yellow toner image, so that the toner images of the plurality of colors are superimposed upon each other. This causes a color image to be formed on the belt 12. The toner images that have been transferred to the belt 12 are transferred to recording materials 70 to 73 at a second transfer section including the belt 12 and a second transfer roller 9 serving as a second transfer unit. The recording materials 70 to 73 to which the toner images have been transferred at the second transfer section are discharged onto a discharge tray 14 after subjecting the toner images to thermal fixing using heat and pressure at a fixing device 13, serving as a fixing unit. After the second transfer, any residual toner on the surface of the belt 12 is cleaned off by a cleaning blade 2, serving as a cleaning unit. The cleaned off toner is accumulated in a waste toner container 1. The blade 2 contacts the belt 12, and scrapes and cleans off any residual toner on the belt 12. By the above-described operations, a full-color image is formed.

The recording materials 70 are fed along a conveying path 100 by a feeding roller 50, serving as a feeding unit, from an accommodation cassette 60, serving as an accommodation unit that accommodates the recording materials. The accommodation cassette 60 includes an inner wall that regulates leading edges of the recording materials 70, and accommodates the recording materials 70 while their leading edges are regulated by the inner wall. After being fed by the roller 50, the recording materials 70 are conveyed towards the second transfer section by a registration roller pair 40 and a conveying roller 54*a*, serving as conveying units. A separating roller 54*b*, serving as a separating unit, opposes the roller 54*a*, and rotates in accordance with the rotation of the roller 54*a* and in a direction in which the recording materials 70 are conveyed downstream. A torque limiter is connected to the roller 54*b*. When a load that is greater than or equal to a certain load is applied, the roller 54*b* stops rotating. Therefore, when the recording materials 70 are fed while being superimposed upon each other due to the influence of, for example, friction, it is possible to separate the recording materials 70 one at a time at a nip formed by the roller 54*a* and the roller 54*b*. A registration sensor 6, serving as a detecting unit that detects leading edges and trailing edges of the recording materials 70, is provided beyond the roller pair 40. Here, the phrase "a leading edge of a recording material 70" refers to an end portion of the recording material 70 at a downstream side in a conveying direction thereof, whereas the phrase "a trailing edge of a recording material 70" refers to an end portion at an upstream side of the recording material 70 in the conveying direction thereof. The roller 50, the roller 54*a*, and the roller pair 40 feed and convey the recording materials 70 when they are rotated by driving force of a motor 20, serving as a driving unit, transmitted thereto. In the embodiment, the rotation speed of the motor 20 is controlled so that the recording materials 70 are fed and conveyed at a constant speed.

The feeding devices 31 to 33 are optional devices that are removable from the device 30. As shown in FIG. 1, the feeding devices 31 to 33 are removable not only from the device 30, but also from other feeding devices. In the embodiment, the feeding devices 31 to 33 need not be removable optional devices. They may be fixed on the device 30. The feeding devices 31 to 33 feed and convey, respectively, the recording materials 71 to 73 to the device 30. The recording materials 71 to 73 are fed, respectively, from the accommodation cassettes 61 to 63 (serving as accommodation units that accommodate the recording materials) to the conveying path 100 by feeding rollers 51 to 53, serving as feeding units. The accommodation cassettes 61 to 63 include, respectively, inner walls that regulate leading edges of the recording materials 71 to 73, and accommodate, respectively, the recording materials 70 to 73 while their leading edges are regulated by the inner walls. After being fed by the rollers 51 to 53, the recording materials 71 to 73 are conveyed towards the roller pair 40 by respective conveying roller pairs 41 to 43 and respective conveying rollers 55*a* to 57*a*, serving as conveying units. Then, the recording materials 71 to 73 are conveyed towards the second transfer section by the roller pair 40. Separating rollers 55*b* to 57*b*, serving as separating units, oppose the respective rollers 55*a* to 57*a*, and rotate in accordance with the rotations of the respective rollers 55*a* to 57*a* and in directions in which the respective recording materials 71 to 73 are conveyed downstream. A torque limiter is connected to the rollers 55*b* to 57*b*. When a load that is greater than or equal to a certain load is applied, the rollers 55*b* to 57*b* stop rotating. Therefore, when the recording materials 71 to 73 are fed while being superimposed upon each other due to the influence of, for example, friction, it is possible to separate the recording materials 71 to 73 one at a time at nips formed by the rollers 55*a* to 57*a* and the corresponding rollers 55*b* to 57*b*. Conveyance sensors 91 to 93, serving as detecting units that detect the leading edge and the trailing edge of the recording materials 71 to 73, respectively, are provided beyond the corresponding roller pairs 41 to 43. Motors 21 to 23, serving as driving units, are provided at the feeding devices 31 to 33, respectively. The roller 51, the roller 55*a*, and the roller pair 41 feed and convey the recording materials 71 when they are rotated by driving force of the motor 20 transmitted thereto. The roller 52, the roller 56*a*, and the roller pair 42 feed and convey the recording materials 72 when they are rotated by driving force of the motor 22 transmitted thereto. The roller 53, the roller 57*a*, and the roller pair 43 feed and convey the recording materials 73 when they are rotated by driving force of the motor 23 transmitted thereto. In the embodiment, the rotation speeds of the motors 21 to 23 are controlled so that the respective recording materials 71 to 73 are fed and conveyed at constant speeds.

The feeding devices according to the embodiment are formed so that, when the roller pair 43 is rotated by driving the motor 23, the roller pairs 41 and 42 that are positioned downstream from the roller pair 43 in the conveying direction of recording materials rotate. Therefore, it is not necessary to drive the motors 21 and 22 for conveying the recording materials 73 to the roller pair 40. Consequently, it is no longer necessary to supply electric power to the motors 21 and 22, so that the overall power consumption can be reduced. Further, since it is possible to reduce the amount of driving of the motors, which become sources of vibration, that is, the cause of noise, it is possible to reduce noise. Similarly, when the recording materials 72 are to be conveyed to the roller pair 40, since the roller pair 41 is rotated by driving the motor 22, it is not necessary to drive the motor 21. In the embodiment, the operation for moving recording materials from the accommodation cassettes to the conveying path 100 is defined as "feed", whereas the operation for moving downstream the recording materials in the conveying path 100 is defined as "convey".

Description of Block Diagram Related to Controlling Operations

Figure 2:
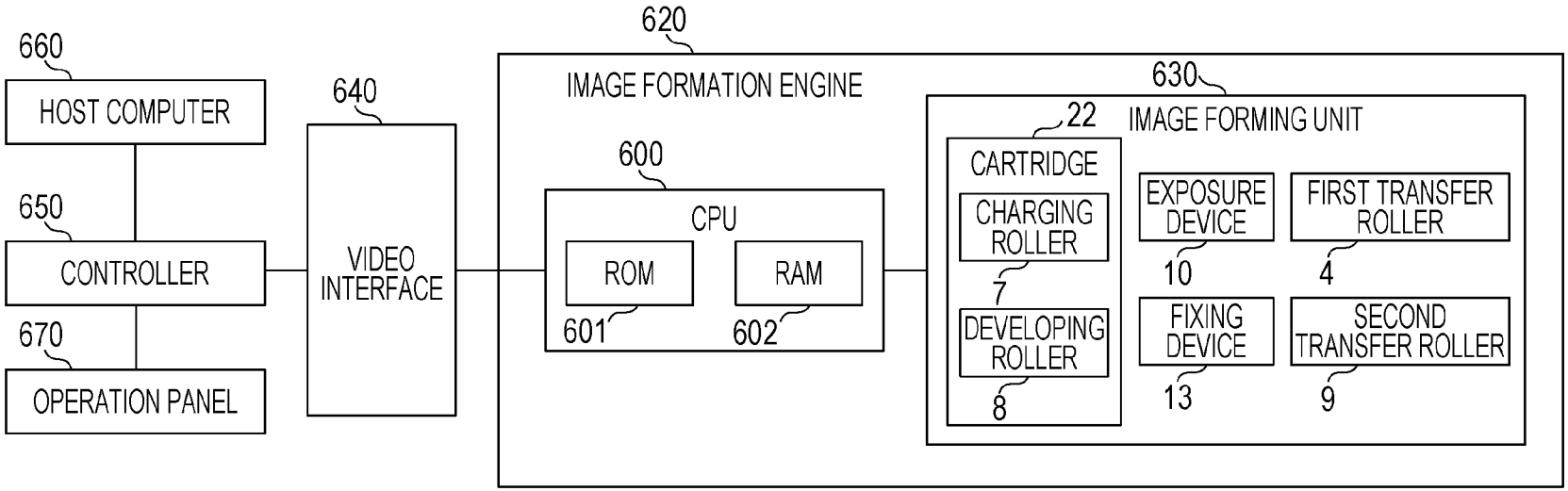
FIG. 2 is a block diagram related to controlling operations according to the first embodiment of the present invention(s).

The block diagram in FIG. 2 related to controlling operations for describing a system configuration of the device 30 is described. A controller 650 connected to a host computer 660 issues an image formation instruction to an image formation engine 620 via a video interface 640. A CPU 600 included in the engine 620 controls an image forming unit 630 in accordance with the image formation instruction. The CPU 600 operates on the basis of a control program stored in ROM 601, and uses RAM 602 as a work area. The image forming unit 630 includes a cartridge 22, an exposure device 10, a fixing device 13, a first transfer roller 4, and a second transfer roller 9. The cartridge 22 includes a charging roller 7 and a developing roller 8. The CPU 600 controls the motor 20 of the device 30, and the motors 21 to 23 of the corresponding feeding devices 31 to 33. The CPU 600 stores in RAM 602 timings in which the sensors 6 and 91 to 93 detect recording materials. A user can input the sizes of the recording materials 70 to 73, which are accommodated in the corresponding cassettes 70 to 73, from an operation panel 670, serving as an input unit, of the device 30. The controller 650 informs the CPU 600 about the sizes of the recording materials 70 to 73 via the interface 640, and sets the lengths of the recording materials 70 to 73 in the conveying direction thereof on the basis of the sizes of recording materials 70 to 73. The CPU 600 further stores this information in RAM 602.

Although, up to now, the controlling operations performed on the image forming unit 630 are described on the basis of the operations of the CPU 600, part or all of the controlling operations performed by the CPU 600 may be performed using ASIC, which is an integrated circuit.

Method for Selecting Sensor that Becomes Reference of Feeding Timing

Figure 3:
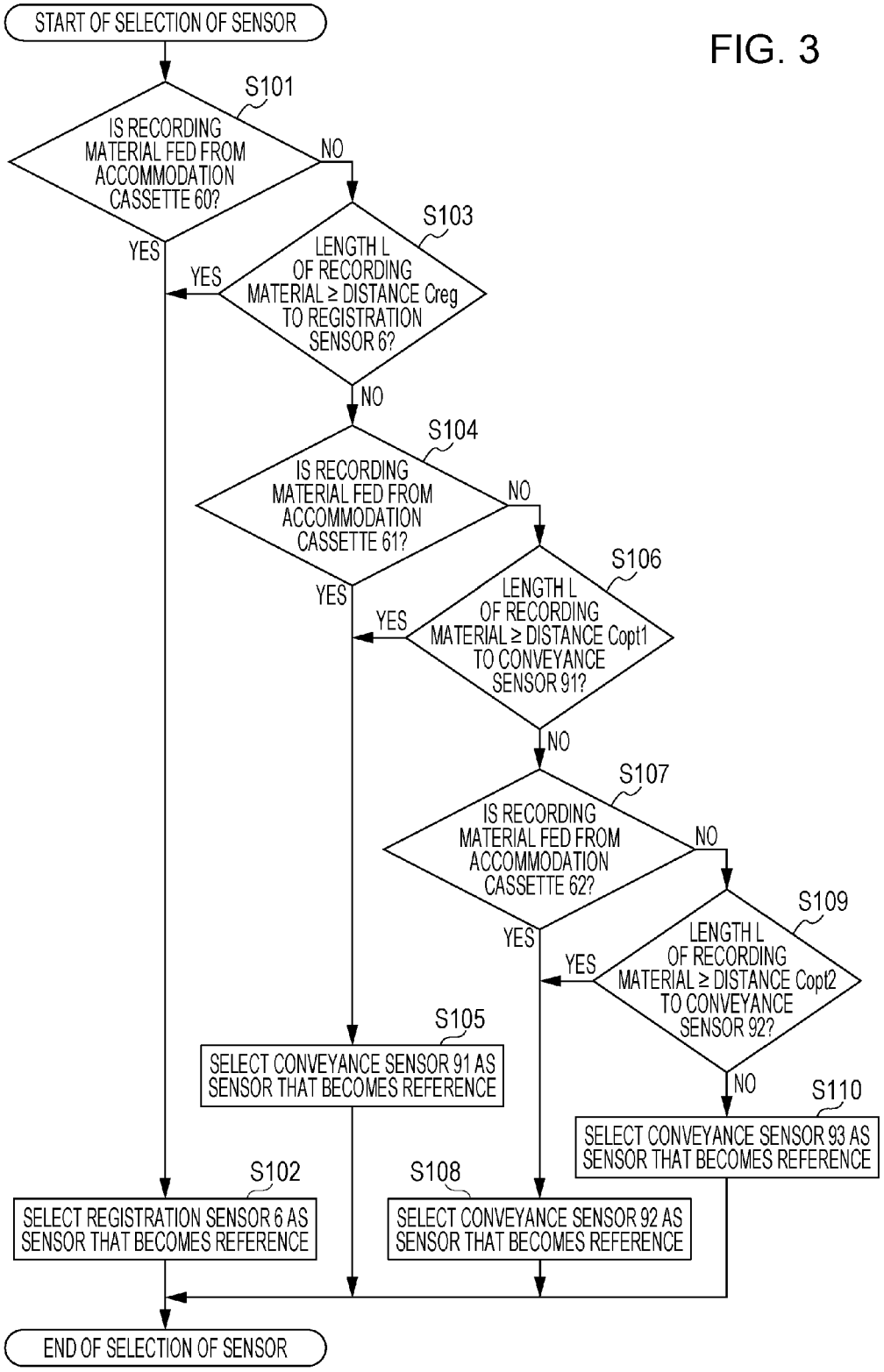
FIG. 3 is a flowchart related to selection of a sensor according to the first embodiment of the present invention(s).

Next, a timing in which recording materials are fed is described. In the embodiment, from among the plurality of sensors 6 and 91 to 93, one sensor is selected to feed recording materials from each of the cassettes in accordance with the detection result provided by the selected sensor. The method for selecting a sensor is described with reference to the flowchart in FIG. 3. Controlling operations based on this flowchart are executed by, for example, the CPU 600 (described with reference to FIG. 2) on the basis of a program that is stored in ROM 601.

First, in order to select a sensor, which becomes a reference of a timing in which recording materials are fed, the CPU 600 determines whether or not the cassette where the feeding is started is the cassette 60 (Step S101). If the cassette where the feeding is started is the cassette 60, the CPU 600 selects the sensor 6 as the sensor that becomes the reference (Step S102). If the cassette where the feeding is started is not the cassette 60, the CPU 600 determines whether or not a length L [mm] in the conveying direction of a recording material that is fed is greater than or equal to a distance Creg [mm] to the sensor 6 (Step S103). Here, the length L is set by a user using the operation panel 670. The distance Creg to the sensor 6 refers to the distance at the conveying path 100 from the cassette where the feeding is started to the sensor 6. More specifically, the distance Creg refers to the distance at the conveying path 100 from the position of leading edges of the recording materials that are accommodated in the cassette where the feeding is started to the position where the recording materials are detected by the sensor 6. In the embodiment, the phrase "the position of the leading edges of the recording materials accommodated in the cassettes" refers to an ideal position where the accommodated recording materials are not taken out due to the influence of, for example, friction of a recording material that is fed first. This position corresponds to where the inner wall of the cassette regulates the leading edges of the accommodated recording materials. If the length L is greater than or equal to the distance Creg, the CPU 600 selects the sensor 6 as the sensor that becomes the reference (Step S102). That is, the timing in which a subsequent second recording material is fed from the cassette is after the detection of the leading edge of a first recording material that is fed first.

If the length L is less than the distance Creg, the CPU 600 determines whether or not the cassette where the feeding is started is the cassette 61 (Step S104). If the cassette where the feeding is started is the cassette 61, the CPU 600 selects the sensor 91 as the sensor that becomes the reference (Step S105). If the cassette where the feeding is started is not the cassette 61, the CPU 600 determines whether the length L [mm] in the conveying direction of recording materials that are fed is greater than or equal to a distance Copt1 [mm] to the sensor 91 (Step S106). Here, the distance Copt1 to the sensor 91 refers to the distance at the conveying path 100 from the cassette where the feeding is started to the sensor 91. More specifically, the distance Copt1 refers to the distance at the conveying path 100 from the position of leading edges of the recording materials that are accommodated in the cassette where the feeding is started to the position where the recording materials are detected by the sensor 91. If the length L is greater than or equal to the distance Copt1, the CPU 600 selects the sensor 91 as the sensor that becomes the reference (Step S105).

If the length L is less than the distance Copt1, the CPU 600 determines whether or not the cassette where the feeding is started is the cassette 62 (Step S107). If the cassette where the feeding is started is the cassette 62, the CPU 600 selects the sensor 92 as the sensor that becomes the reference (Step S108). If the cassette where the feeding is started is not the cassette 62, the CPU 600 determines whether the length L [mm] in the conveying direction of recording materials that are fed is greater than or equal to a distance Copt2 [mm] to the sensor 92 (Step S109). Here, the distance Copt2 to the sensor 92 refers to the distance at the conveying path 100 from the cassette where the feeding is started to the sensor 92. More specifically, the distance Copt2 refers to the distance at the conveying path 100 from the position of leading edges of the recording materials that are accommodated in the cassette where the feeding is started to the position where the recording materials are detected by the sensor 92. If the length L is greater than or equal to the distance Copt2, the CPU 600 selects the sensor 92 as the sensor that becomes the reference (Step S108). If the length L is less than the distance Copt2, the CPU 600 selects a sensor 93 as the sensor that becomes the reference (Step S110). In the embodiment, a length Lmin [mm] in the conveying direction of smallest recording materials that are supported by the cassette is greater than or equal to a distance Copt3 [mm] to the sensor 93. Here, the distance Copt3 [mm] to the sensor 93 refers to the distance at the conveying path 100 from the cassette where the feeding is started to the sensor 93. More specifically, the distance Copt3 refers to the distance at the conveying path 100 from the position of leading edges of the recording materials that are accommodated in the cassette where the feeding is started to the position where the recording materials are detected by the sensor 93.

On the basis of the above-described flowchart, a sensor that becomes a reference of a timing in which a subsequent second recording material is fed is selected from among the plurality of sensors. That is, a sensor that is positioned at a lowermost stream side in the conveying direction is selected from among the sensors whose distances in the conveying path 100 from the cassette are less than or equal to the length of the recording materials in the conveying direction thereof.

Method for Determining Feeding Timing

Figure 4A:
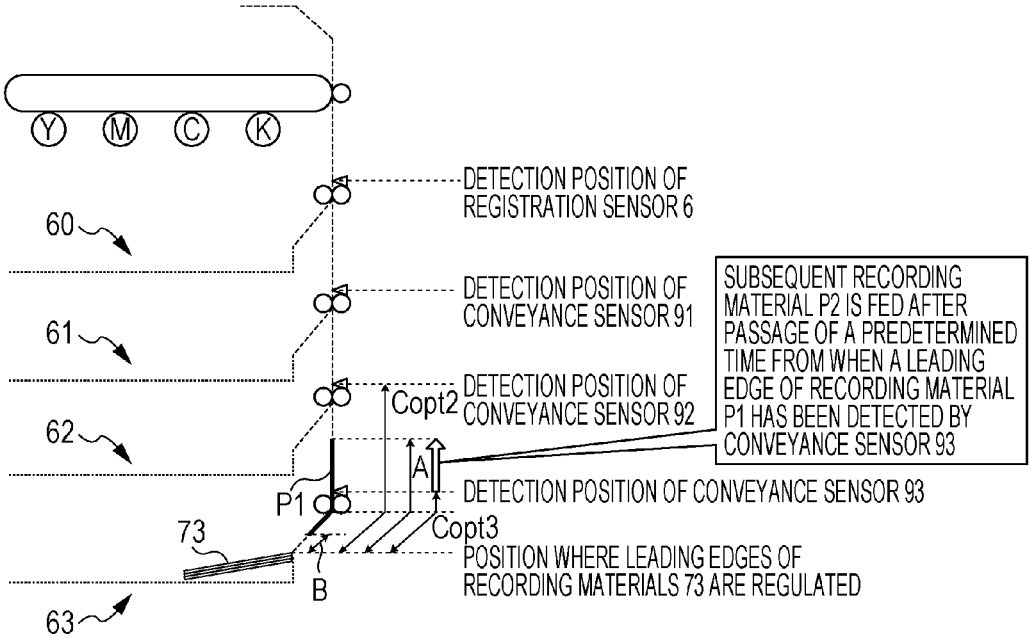
FIGS. 4A and 4B illustrate feeding timings.
Figure 4B:
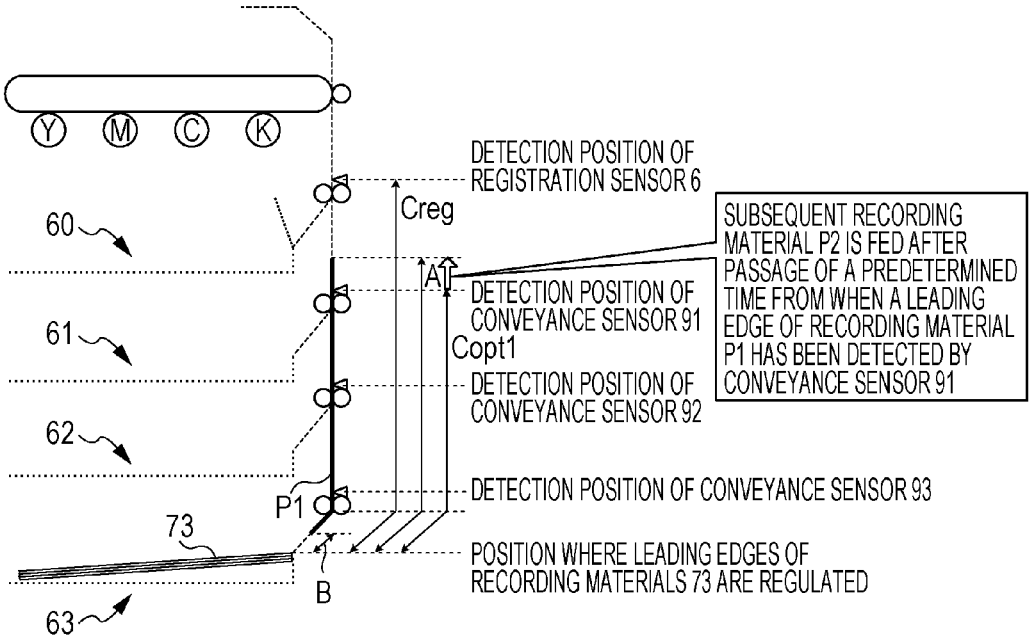

Next, a method for determining a timing in which recording materials are fed according to the embodiment is described with reference to FIGS. 4A and 4B. In FIGS. 4A and 4B, the operations that are performed when the recording materials 73 are continuously fed from the cassette 63 are described.

FIG. 4A illustrates a method for determining a feeding timing when the recording materials 73 that are accommodated in the cassette 63 are small (that is, the length of the recording materials in the conveying direction is short). Here, the word "small" means that the length L [mm] of the recording materials in the conveying direction is less than the distance Copt2 [mm] from the cassette 63 to the sensor 92. First, in accordance with the flowchart shown in FIG. 3, the CPU 600 selects a sensor that becomes a reference. In this case, the sensor 93 is selected as the sensor that becomes the reference. The CPU 600 adds the length L [mm] in the conveying direction of the recording materials 73, which is set by a user, and a predetermined interval B [mm] of the recording materials and determines a feeding interval A (=L+B)[mm]. Here, the interval between the recording materials refers to the distance between a trailing edge of a first recording material P1, which is fed first, and a leading edge of a second recording material P2, which is the next recording material that is set after the recording material P1. As indicated by the following Formula (1), the CPU 600 determines the timing in which the second recording material P2 is fed in accordance with a timing in which the leading edge of the first recording material P1 is detected by the sensor 93 serving as the reference:

timing in which second recording material $P2$ is *fed*=timing in which leading edge of first recording material $P1$ is detected by sensor 93+{(feeding interval $A$−distance Copt3 to sensor 93)/conveying speed} (1)

where the conveying speed [mm/sec] is the speed of the recording materials that are conveyed in the conveying path. Therefore, the second recording material P2 is fed after the passage of a predetermined time from when the leading edge of the first recording material P1 has been detected by the sensor 93.

FIG. 4B illustrates a method for determining a feeding timing when the recording materials 73 that are accommodated in the cassette 63 are large (that is, the length of the recording materials in the conveying direction is long). Here, the word "large" means that the length L [mm] of the recording materials in the conveying direction is greater than or equal to the distance Copt1 [mm] from the cassette 63 to the sensor 91. Here, as shown in FIG. 4B, of the large recording materials, those recording materials whose length in the conveying direction is less than the distance Creg

[mm] from the cassette 63 to the sensor 6 are used. First, in accordance with the flowchart shown in FIG. 3, the CPU 600 selects a sensor that becomes a reference. In this case, the sensor 91 is selected as the sensor that becomes the reference. Similarly to the case in which the recording materials are small, the CPU 600 adds the length L [mm] in the conveying direction of the recording materials 73, which is set by a user, and a predetermined interval B [mm] of the recording materials, and determines a feeding interval A (=L+B)[mm]. Then, as indicated by the following Formula (2), the CPU 600 determines the timing in which a second recording material P2 is fed in accordance with a timing in which a leading edge of a first recording material P1 is detected by the sensor 91 serving as the reference:

timing in which second recording material *P*2 is *fed*=timing in which leading edge of first recording material *P*1 is detected by sensor 91+{(feeding interval *A*−distance Copt1 to sensor 91)/conveying speed} (2)

Therefore, the second recording material P2 is fed after the passage of a predetermined time from when the leading edge of the first recording material P1 has been detected by the sensor 91.

In existing image forming apparatuses, regardless of the length of the recording materials 73 in the conveying direction, as shown in FIG. 4A, the timing in which the second recording material P2 is fed is determined by the sensor 93 that is closest to the cassette 63. Therefore, when the recording materials 73 are large as shown in FIG. 4B, it takes a longer time to feed the second recording material P2 from when the first recording material P1 has been detected by the sensor 93. In addition, when, for example, slippage at the roller pairs 40 to 42 occurs during this time, the sensor 93 cannot detect any delays in the conveyance of the recording material. Therefore, it is not possible to delay the timing in which the second recording material P2 is fed with the influence of the slippage being considered. That is, it is better for the time taken to feed the second recording material P2 from when the first recording material P1 has been detected by the sensor to be short.

If, regardless of the length of the recording materials 73 in the conveying direction, as shown in FIG. 4B, the timing in which the second recording material P2 is fed is determined by the sensor 91 at the downstream side, when the recording materials 73 are small as shown in FIG. 4A, the interval between the recording materials becomes too wide.

Although, in FIGS. 4A and 4B, the operations when the recording materials 73 are fed from the cassette 63 are described, the same applies for the case where the recording materials 71 are fed from the cassette 61 and the case where the recording materials 72 are fed from the cassette 62.

By performing the above, in the embodiment, a sensor that is positioned at the lowermost stream side in the conveying direction is selected from among the sensors where the distances in the conveying path 100 from the cassette are less than or equal to the length of the recording materials in the conveying direction. Then, the timing in which the second recording material P2 is fed is determined in accordance with the detection result provided by the sensor. This makes it possible to reduce the time taken to feed the second recording material P2 from when the first recording material P1 has been detected by the sensor. Therefore, it is possible to reduce variations in feeding and conveyance, caused by, for example, slippage, up to this sensor; to reduce the interval between the recording materials; and to control the interval between the recording materials to a constant interval.

In the embodiment, there is described the structure where the main body device 30 includes, for example, the CPU 600, and where the timing in which recording materials are fed is determined. However, a structure where the feeding devices 31 to 33 include controlling units thereof, and where the timing in which recording materials are fed is determined may be used.

Although, in the embodiment, the length Lmin in the conveying direction of the smallest recording materials that are supported by the cassette is greater than or equal to the distance to the closest sensor, this relationship need not be established at all times. Even if the distance Lmin is less than the distance to the closest sensor, the interval between the recording materials no longer becomes wider than is necessary as a result of selecting this sensor and feeding the second recording material.

As a controlling method differing from that according to the embodiment, the timing in which the second recording material P2 is fed may be determined with reference to a timing in which a particular sensor that is positioned at an uppermost stream side in the conveying direction detects the trailing edge of the first recording material P1. Here, the phrase "a particular sensor that is positioned at an uppermost stream side" refers to, for example, the sensor 93 when the recording materials 73 are fed from the cassette 63. When the controlling method is a method for determining the timing in which the second recording material 73 is fed with reference to the timing in which the sensor 93 detects the trailing edge of the first recording material 73, it is possible to reduce conveyance variations than in existing methods. Here, the expression "existing methods" refers to methods for determining the timing in which the second recording material 73 is fed with reference to the timing in which the leading edge of the first recording material 73 is detected by the sensor 93. However, as the interval between the trailing edge of the first recording material 73 and the leading edge of the second recording material 73 is reduced, it becomes necessary to dispose the sensor 93 that is positioned at the uppermost stream side close to the cassette 63. However, since the roller 57*a* and the roller 57*b* are disposed close to the cassette 63, the sensor 93 cannot be disposed very close to the cassette 63. However, according to the present invention, regardless of such mechanical limitations, it is possible to reduce the influence of feeding and conveyance variations caused by, for example, slippage; to reduce the interval between the recording materials; and to control the interval between the recording materials to a constant interval.

Second Embodiment

In the first embodiment, the structure of the image forming apparatus 35 on which optional devices are mounted is described. In the second embodiment, the structure of an image forming apparatus 34 on which optional devices are not mounted is described. The descriptions of the main portions are the same as those according to the first embodiment. Here, only portions differing from those according to the first embodiment are described.

Description of Image Forming Apparatus

Figure 5:
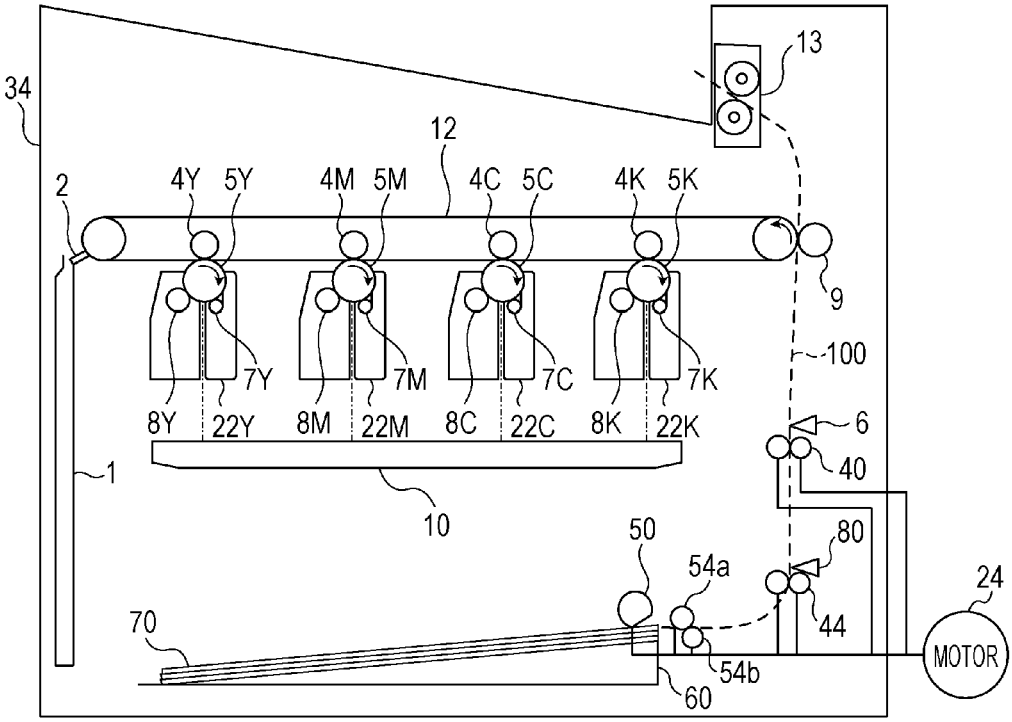
FIG. 5 is a sectional view of an image forming apparatus according to a second embodiment of the present invention(s).

FIG. 5 is a sectional view of the image forming apparatus 34 according to the second embodiment. Recording materials 70 are fed along a conveying path 100 by a feeding roller 50, serving as a feeding unit, from an accommodation cassette 60, serving as an accommodation unit that accommodates the recording materials. The accommodation cassette 60 includes an inner wall that regulates leading edges of the recording materials 70, and accommodates the recording materials 70 while their leading edges are regulated by the inner wall. After being fed by the roller 50, the recording materials 70 are conveyed towards a second transfer section by a registration roller pair 40 and a pre-registration conveying roller pair 44 and a conveying roller 54*a*, serving as conveying units. A separating roller 54*b*, serving as a separating unit, opposes the roller 54*a*, and rotates in accordance with the rotation of the roller 54*a* and in a direction in which the recording materials 70 are conveyed downstream. A torque limiter is connected to the roller 54*b*. When a load that is greater than or equal to a certain load is applied, the roller 54*b* stops rotating. Therefore, when the recording materials 70 are fed while being superimposed upon each other due to the influence of, for example, friction, it is possible to separate the recording materials 70 one at a time at a nip formed by the roller 54*a* and the roller 54*b*. A pre-registration sensor 80 that detects leading edges and trailing edges of the recording materials 70 is provided beyond the roller pair 44. The roller 50, the roller 54*a*, the roller pair 44, and the roller pair 40 feed and convey the recording materials 70 when they are rotated by driving force of a motor 24, serving as a driving unit, transmitted thereto. In the embodiment, the rotation speed of the motor 24 is controlled so that the recording materials 70 are fed and conveyed at a constant speed. A system configuration of the device 34 is the same as that according to the first embodiment, and is as shown in FIG. 2.

Method for Selecting Sensor that Becomes Reference for Feeding Timing

Figure 6:
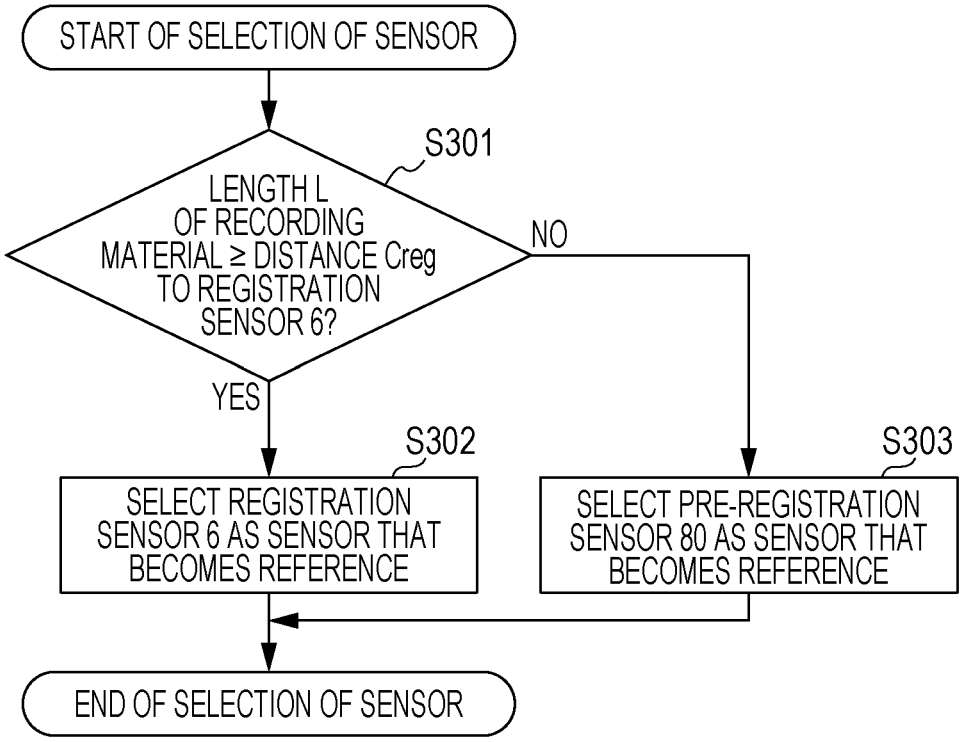
FIG. 6 is a flowchart related to selection of a sensor according to the second embodiment of the present invention(s).

Next, a timing in which recording materials are fed is described. In the embodiment, one sensor is selected from sensors 6 and 80, and recording materials are fed from a cassette 60 in accordance with the detection result provided by the selected sensor. A method for selecting a sensor is described with reference to the flowchart of FIG. 6. Control based on this flowchart is executed by, for example, a CPU 600 (described with reference to FIG. 2) on the basis of a program that is stored in ROM 601.

First, the CPU 600 determines whether or not a length L [mm] in a conveying direction of the recording materials that are fed is greater than or equal to a distance Creg [mm] to the sensor 6 (Step S310). Here, the length L is set by a user using an operation panel 670. The distance Creg to the sensor 6 refers to the distance at the conveying path 100 from the cassette 60 to the sensor 6. More specifically, the distance Creg refers to the distance at the conveying path 100 from the position of leading edges of the recording materials 70 that are accommodated in the cassette 60 to the position where the recording materials 70 are detected by the sensor 6. If the length L is greater than or equal to the distance Creg, the CPU 600 selects the sensor 6 as the sensor that becomes the reference (Step S302). That is, a timing in which a subsequent second recording material is fed from the cassette 60 is after the detection of the leading edge of a first recording material that is fed first. If the length L is less than the distance Creg, the CPU 600 selects the sensor 80 as the sensor that becomes the reference (Step S303).

On the basis of the above-described flowchart, a sensor that becomes a reference of a timing in which a subsequent second recording material is fed is selected from among the plurality of sensors. That is, a sensor that is positioned at a lowermost stream side in the conveying direction is selected from among the sensors whose distances in the conveying path 100 from the cassette 60 are less than or equal to the length of the recording materials in the conveying direction thereof.

The operations that are performed after the selection of a sensor are the same as those according to the first embodiment. In accordance with the timing in which the leading edge of the first recording material P1 is detected by the sensor serving as the reference, the timing in which the second recording material P2 is fed is determined.

By performing the above, in the embodiment, a sensor that is positioned at the lowermost stream side in the conveying direction is selected from among the sensors where the distances in the conveying path 100 from the cassette are less than or equal to the length of the recording materials in the conveying direction. Then, the timing in which the second recording material P2 is fed is determined in accordance with the detection result provided by the sensor. This makes it possible to reduce the time taken to feed the second recording material P2 from when the first recording material P1 has been detected by the sensor. Therefore, it is possible to reduce variations in feeding and conveyance, caused by, for example, slippage, up to this sensor; to reduce the interval between the recording materials; and to control the interval between the recording materials to a constant interval.

Modifications

Figure 7:
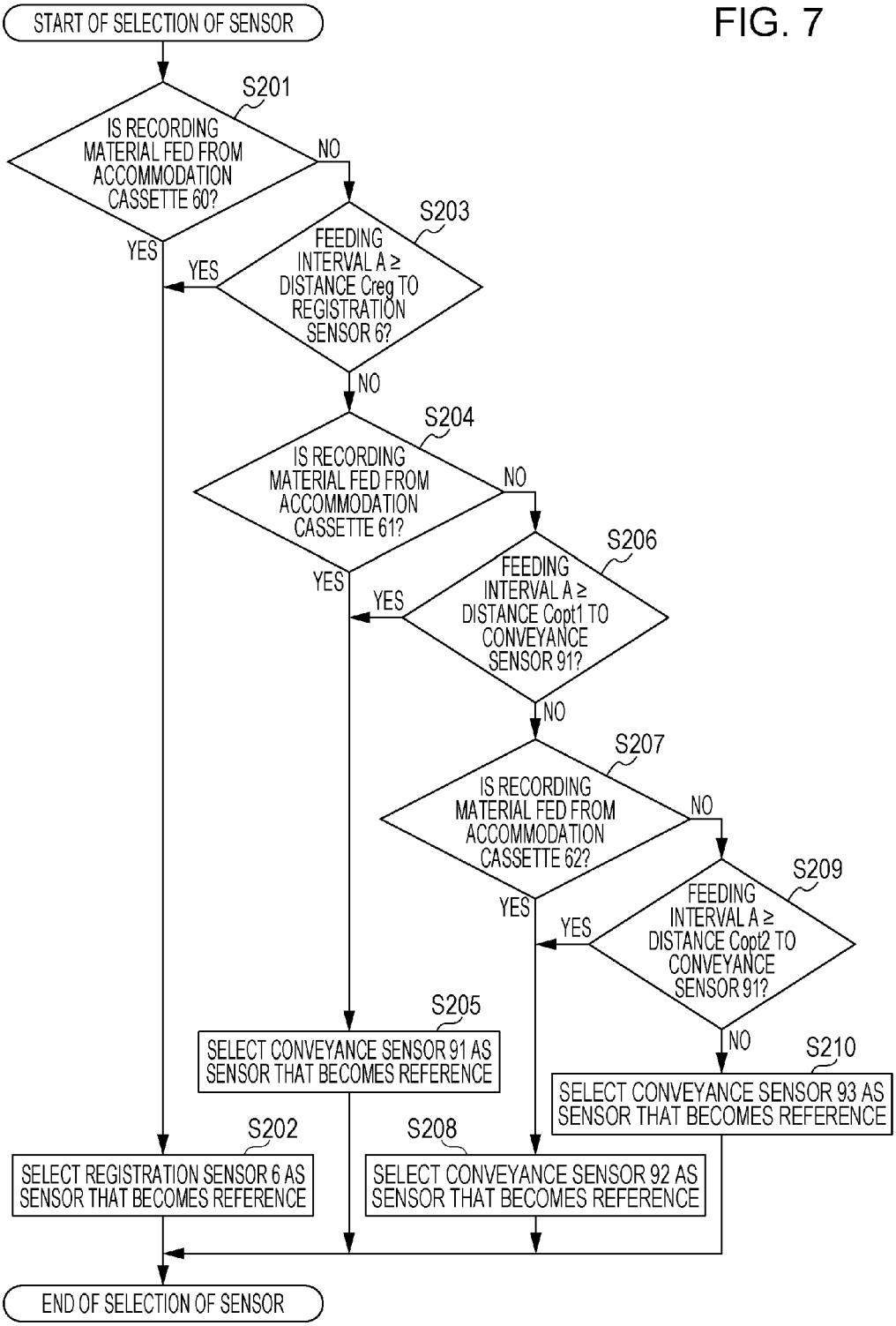
FIG. 7 is a flowchart related to selection of a sensor according to a modification of the present invention(s).

In the above-described embodiments, a sensor that is positioned at the lowermost stream side in the conveying direction is selected as a sensor that becomes a reference from among the sensors whose distances in the conveying path 100 from the cassette are less than or equal to the length of recording materials in the conveying direction thereof. However, the sensor that becomes the reference may be selected from among the sensors whose distances in the conveying path 100 from the cassette are less than or equal to the feeding interval including the interval between recording materials. A method for selecting a sensor that becomes a reference is illustrated in the flowchart in FIG. 7. The flowchart in FIG. 7 differs from the flowchart in FIG. 3 in operations for comparing the lengths. Control based on this flowchart in FIG. 7 is executed by, for example, the CPU 600 (described with reference to FIG. 2) on the basis of a program that is stored in ROM 601. After selecting the sensor that becomes the reference in accordance with the flowchart in FIG. 7, a timing in which a second recording material P2 is fed is determined in accordance with a timing in which a leading edge of a recording material P1 that is fed first is detected by the sensor that becomes the reference. This allows a sensor that is situated further downstream than that in the above-described embodiments to be selected as the sensor that becomes the reference. Consequently, it is possible to further reduce the time taken to feed the second recording material P2 from when the leading edge of the first recording material P1 has been detected. As a result, it is possible to reduce the interval between the recording materials and to control the interval between the recording materials to a constant interval.

In the above-described embodiments, control for feeding recording materials with an interval being provided between a trailing edge of a first recording material and a leading edge of a second recording material is described. However, the recording materials may be fed without providing such an interval. The timing in which the second recording material is fed in this case may be calculated by replacing the feeding interval A in Formulas (1) and (2) with the length L of the recording materials in the conveying direction (that is, an interval B=0). This makes it possible to feed the recording materials using a selected sensor without providing an interval between the trailing edge of the first recording material and the leading edge of the second recording material.

In the above-described embodiments, as the position of leading edges of recording materials accommodated in a cassette, the position of leading edges of the recording materials that are not taken out due to the influence of, for example, friction is set as a reference. However, the position of the leading edges of the recording materials may be defined considering the influence of the taking out of the recording materials. For example, when the recording materials 70 are fed from the cassette 60, the recording materials 70 may be taken out at most to the position of the nip formed by the roller 54*a* and the roller 54*b* due to the influence of, for example, friction. Therefore, the position of the leading edges of the recording materials may be defined as the position of the nip considering the influence of the taking out of the recording materials. Consequently, if the length by which the recording materials are taken out is longer than the predetermined interval between the recording materials, the first recording material and the second recording material are no longer fed and conveyed when they are superimposed upon each other.

Although, in the above-described embodiments, a sensor that is positioned at the lowermost stream side in the conveying direction is selected from among the sensors whose distances in the conveying path 100 from the cassette are less than or equal to the length of recording materials in the conveying direction, the present invention is not limited thereto. For example, when, in the first embodiment, the recording materials are large as shown in FIG. 4B, the timing in which the recording materials are fed may be determined by selecting the sensor 92 instead of the sensor 91.

In the above-described embodiments, control for feeding and conveying recording materials at a constant speed is assumed. The main cause of feeding and conveyance variations is slippage caused by, for example, wear at the surface of each roller. However, when the structure is one that allows acceleration and deceleration of recording materials by controlling a motor, feeding and conveying variations occur even when, for example, variations in load occur when the driving of the rollers 50 to 53, the rollers 54*a* to 57*a*, and the roller pairs 40 to 43 is temporarily stopped or started, or the rollers 50 to 53, the rollers 54*a* to 57*a*, and the roller pairs 40 to 43 are accelerated or decelerated.

In the above-described embodiments, the length in the conveying direction of recording materials accommodated in a cassette is set by a user using the panel 670. However, the present invention is not limited thereto. For example, the length of the recording materials in the conveying direction may be detected by causing the CPU 600 to detect the position of a regulating plate that is provided at the cassette and that serves as a regulating unit that regulates trailing edges of the accommodated recording materials. Alternatively, when an image is formed on a first recording material after recording materials have been accommodated in a cassette, on the basis of a timing in which a particular sensor detects leading edges and trailing edges of the recording materials and the conveying speed of the recording materials, the CPU 600 may detect the length of the recording materials in the conveying direction.

Although, in the above-described embodiments, a laser printer is exemplified, the image forming apparatus to which the present invention is applied is not limited thereto. The image forming apparatus may be another type of printer, such as an inkjet printer, or a copying machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A feeding device comprising:

an accommodation unit that accommodates recording materials;

a feeding unit that feeds a second recording material accommodated in the accommodation unit to a conveying path, after feeding a first recording material accommodated in the accommodation unit to the conveying path, with an interval being provided between a trailing edge of the first recording material and a leading edge of the second recording material;

a first detecting unit that detects a recording material fed by the feeding unit at a first position in the conveying path;

a second detecting unit that detects a recording material fed by the feeding unit at a second position that is downstream from the first position in a conveying direction of the recording material; and a control unit that controls the feeding unit, wherein, in a case where the interval is a first length, the control unit controls the feeding unit to feed the second recording material based on a timing in which the first detecting unit detects the first recording material, and wherein, in a case where the interval is a second length which is longer than the first length, the control unit controls the feeding unit to feed the second recording material based on a timing in which the second detecting unit detects the first recording material.

2. The feeding device according to claim 1, wherein, in a case where a first sum of a length of recording materials accommodated in the accommodation unit in the conveying direction and the first length is shorter than a predetermined length, the control unit controls the feeding unit to feed the second recording material based on the timing in which the first detecting unit detects the first recording material, and wherein, in a case where a second sum of the length of recording materials accommodated in the accommodation unit in the conveying direction and the second length is longer than or equal to the predetermined length, the control unit controls the feeding unit to feed the second recording material based on the timing in which the second detecting unit detects the first recording material.

3. The feeding device according to claim 2, further comprising:

an input unit configured to input information related to the length of the recording materials accommodated in the accommodation unit;

wherein the control unit that sets the length of the recording materials on a basis of the information input from the input unit.

4. The feeding device according to claim 2, further comprising:

a regulating unit that regulates a trailing edge of each of the recording materials accommodated in the accommodation unit;

wherein the control unit that sets the length of the recording materials accommodated in the accommodation unit, on a basis of a position of the regulating unit.

5. The feeding device according to claim 2, wherein the control unit that sets the length of the recording materials accommodated in the accommodation unit, on a basis of a conveying speed of the recording material, and a time from when the first detecting unit detects the leading edge of the recording material fed by the feeding unit to when the first detecting unit detects the trailing edge of the recording material or a time from when the second detecting unit detects the leading edge of the recording material fed by the feeding unit to when the second detecting unit detects the trailing edge of the recording material.

6. The feeding device according to claim 2, wherein the timing in which the first detecting unit detects the first recording material corresponds to a timing in which the first detecting unit detects a leading edge of the first recording material, and wherein the timing in which the second detecting unit detects the first recording material corresponds to a timing in which the second detecting unit detects the leading edge of the first recording material.

7. The feeding device according to claim 6, wherein the accommodation unit regulates leading edges of the accommodated recording materials at a regulation position, wherein the predetermined length is a distance at the conveying path from the regulation position to the second position.

8. The feeding device according to claim 7, wherein the first sum is longer than or equal to a distance at the conveying path from the regulation position to the first position.

9. The feeding device according to claim 8, wherein, in the case where the first sum is shorter than the distance from the regulation position to the second position, the control unit controls the feeding unit to feed the second recording material at a timing in which a time has passed from the timing in which the first detecting unit detects the leading edge of the first recording material, the time being calculated by dividing a value by a conveying speed of the recording material, the value being obtained by subtracting the distance, from the regulation position to the first position, from the first sum, and wherein, in the case where the second sum is longer than the distance from the regulation position to the second position, the control unit controls the feeding unit to feed the second recording material at a timing in which a time has passed from the timing in which the second detecting unit detects the leading edge of the first recording material, the time being calculated by dividing a value by a conveying speed of the recording material, the value being obtained by subtracting the distance, from the regulation position to the second position, from the second sum.

10. The feeding device according to claim 6, further comprising:

a conveying unit that conveys the recording material fed by the feeding unit; and a separating unit that forms a nip with the conveying unit and separates at the nip a plurality of the recording materials that are superimposed upon each other and fed by the feeding unit, wherein the predetermined length is a distance at the conveying path from the position of the nip to the second position.

11. The feeding device according to claim 10, wherein the first sum is longer than or equal to a distance at the conveying path from a position of the nip to the first position.

12. The feeding device according to claim 11, wherein, in the case where the first sum is shorter than the distance from the position of the nip to the second position, the control unit controls the feeding unit to feed the second recording material at a timing in which a time has passed from the timing in which the first detecting unit detects the leading edge of the first recording material, the time being calculated by dividing a value by a conveying speed of the recording material, the value being obtained by subtracting the distance, from the position of the nip to the first position, from the first sum, and wherein, in the case where the second sum is longer than the distance from the position of the nip to the second position, the control unit controls the feeding unit to feed the second recording material at a timing in which a time has passed from the timing in which the second detecting unit detects the leading edge of the first recording material, the time being calculated by dividing a value by a conveying speed of the recording material, the value being obtained by subtracting the distance, from the position of the nip to the second position, from the second sum.

13. An image forming apparatus comprising:

an accommodation unit that accommodates recording materials;

a feeding unit that feeds a second recording material accommodated in the accommodation unit to a conveying path, after feeding a first recording material accommodated in the accommodation unit to the conveying path, with an interval being provided between a trailing edge of the first recording material and a leading edge of the second recording material;

a first detecting unit that detects a recording material fed by the feeding unit at a first position in the conveying path;

a second detecting unit that detects a recording material fed by the feeding unit at a second position that is downstream from the first position in a conveying direction of the recording material;

an image forming unit that forms an image on a recording material fed by the feeding unit; and a control unit that controls the feeding unit, wherein, in a case where the interval is a first length, the control unit controls the feeding unit to feed the second recording material based on a timing in which the first detecting unit detects the first recording material, and wherein, in a case where the interval is a second length which is longer than the first length, the control unit controls the feeding unit to feed the second recording material based on a timing in which the second detecting unit detects the first recording material.

* * * * *